United States Patent [19]

Jackson et al.

[11] 4,429,637

[45] Feb. 7, 1984

[54] RAILWAY VEHICLE TRUCK

[75] Inventors: Keith L. Jackson, Granite City; Dallas L. Schmitt, Fairview Heights; John L. Schauster, Highland, all of Ill.

[73] Assignee: Lukens General Industries, Inc., Coatesville, Pa.

[21] Appl. No.: 312,994

[22] Filed: Oct. 19, 1981

[51] Int. Cl.[3] ..... B61F 5/38; B61F 5/30; B61F 3/08

[52] U.S. Cl. ..... 105/168; 105/176; 105/200; 105/202; 105/206 R; 105/224.1

[58] Field of Search ..... 105/157 R, 165–170, 105/176, 182 R, 200, 202, 206 R, 208.1, 218 R, 224, 224.1

[56] References Cited

U.S. PATENT DOCUMENTS

| | | | |
|---|---|---|---|
| 2,961,974 | 11/1960 | Seelig, Jr. | 105/168 X |
| 4,040,360 | 8/1977 | Jackson | 105/199 R X |
| 4,067,261 | 1/1978 | Scheffel | 105/218 R X |
| 4,067,262 | 1/1978 | Scheffel | 105/168 |
| 4,075,950 | 2/1978 | Marta et al. | 105/182 R X |
| 4,111,131 | 9/1978 | Bullock | 105/224.1 |
| 4,134,343 | 1/1979 | Jackson | 105/167 |
| 4,136,620 | 1/1979 | Scheffel et al. | 105/168 |
| 4,151,801 | 5/1979 | Scheffel et al. | 105/168 |
| 4,170,179 | 10/1979 | Vogel | 105/168 |
| 4,173,933 | 11/1979 | Kayserling | 105/182 R |
| 4,231,296 | 11/1980 | Jackson | 105/199 R X |
| 4,237,791 | 12/1980 | Jackson et al. | 105/168 |
| 4,258,629 | 3/1981 | Jackson et al. | 105/167 |
| 4,285,280 | 8/1981 | Smith | 105/168 |
| 4,300,454 | 11/1981 | Scheffel | 105/168 |

FOREIGN PATENT DOCUMENTS

| | | | |
|---|---|---|---|
| 1230832 | 12/1966 | Fed. Rep. of Germany | 105/224.1 |
| 2326729 | 12/1974 | Fed. Rep. of Germany | 105/224.1 |
| 2023523 | 1/1980 | United Kingdom | 105/224.1 |

*Primary Examiner*—Robert B. Reeves
*Assistant Examiner*—David F. Hubbuch
*Attorney, Agent, or Firm*—F. Travers Burgess

[57] ABSTRACT

A radial axle railway truck has separate depressed center beam-type side frames mounted at their ends on journal bearing assemblies by means of elastomeric pad devices between downwardly facing surfaces on the side frames and upwardly facing surfaces on the bearing assemblies, the pad devices near the ends of the side frames being at a level higher than the axle centers and laterally inboard of the side frames and those remote from the ends of the side frames being at a level lower than the axle centers and laterally outboard of the side frames, thereby conforming with sloping end portions of the side frames and stabilizing the side frames against tipping transversely. The main frame of the truck has longitudinally extending side members and the side frames mount vertically acting resilient means for supporting the main frame on the side frames. Each side frame is of box section formed with an elongated upwardly open pocket in its depressed central portion receiving vertically resilient means supporting the ends of the elongated side members of a main frame at a low level while maintaining an adequate cross section in the depressed central portions of the respective side frames.

17 Claims, 7 Drawing Figures

RAILWAY VEHICLE TRUCK

BACKGROUND OF THE INVENTION

1. Field of the Invention

The invention relates to railway rolling stock and consists particularly in a radial axle car truck with stably supported side frames.

2. The Prior Art

F. W. Sinclair U.S. Pat. No. 2,981,208 discloses railway trucks in which the transverse framing members are supported on separate side frames by chevron-shaped rubber and metal springs and in which the side frames are supported rigidly on the journal boxes. In the Sinclair patent, each side frame is of box section with its central portion depressed between its end portions which are integral with the journal boxes, and with the chevron spring devices on top of the depressed center portion adjacent the intersections of the end portions and the depressed center portion. Since the side frames of Sinclair are supported directly on the axles, the side frames are not subject to substantial tipping as a result of transverse forces applied to them even though the bolster supporting chevron spring devices are supported on the side frames at a higher level than the axles. In radial axle trucks such as those disclosed in Herbert Scheffel U.S. Pat. Nos. 4,067,261, 4,067,262 and 4,136,620 and Robert L. Bullock Pat. No. 4,111,131, the side frames are mounted on the journal boxes by means of elastomeric pad devices constructed to yield in shear horizontally to accommodate sufficient yawing movements of the respective axles to permit the respective axles to assume radial positions on curved track, but in each of these truck arrangements, the bolster is supported in the conventional way on the side frames by springs seated at a very low level on the bottom chord of truss side frames. R. B. Cottrell U.S. Pat. No. 2,743,682 discloses a truck of the separate side frame type in which the side frames are integral with the journal boxes and of box section depressed between the journal boxes and formed with upwardly open spring pockets in their depressed center section for a group of upright coil springs on which the ends of a transverse bolster are carried, each side frame also being formed with upstanding guide abutments slidably engaging cooperating guide surfaces on the bolster to hold the bolster and side frames in trammed relation with each other. Since the side frames are stably supported directly on the axle journals without any yieldable means between the journal bearings and the side frames, the principal purpose of the pockets of Cottrell is to provide nearly as low a level for the bolster supporting springs as would be provided in a conventional freight car truck having side frames of the queen-post truss type.

SUMMARY OF THE INVENTION

The invention provides a radial axle truck in which the framing consists of separate beam-type side frames resiliently mounted on the journal boxes to accommodate sufficient axle yaw for steering, and with a main frame resiliently supported on the side frames, with the resilient supports of the main frame on the side frames at a level lower than the axle centers and the resilient mountings of the side frames on the journal boxes spaced apart laterally of the journal boxes whereby to enhance the resistance of the side frame to tipping transversely as a result of transverse forces.

The invention provides an anti-tipping, though resilient, support of side frames on journal boxes in a radial axle truck by positioning the resilient support means nearest the end of the side frames inwardly transversely of the truck and the elastomeric pad means on the opposite sides of the journal boxes transversely outwardly.

The invention provides a radial axle truck in which the journal boxes are formed inwardly of the side frames and outwardly of the wheels with extensions parallel to the side frames and projecting towards the center of the truck to mount diagonal interconnections with the respective opposite axle, in which the support of the side frames on the side of the journal boxes nearest the center of the truck is sufficiently outboard laterally to clear the journal box extensions, with the resilient supporting means on the other side of the boxes positioned sufficiently inwardly to stabilize the side frames against lateral tilting forces.

DETAILED DESCRIPTION OF THE INVENTION

Figure 1:
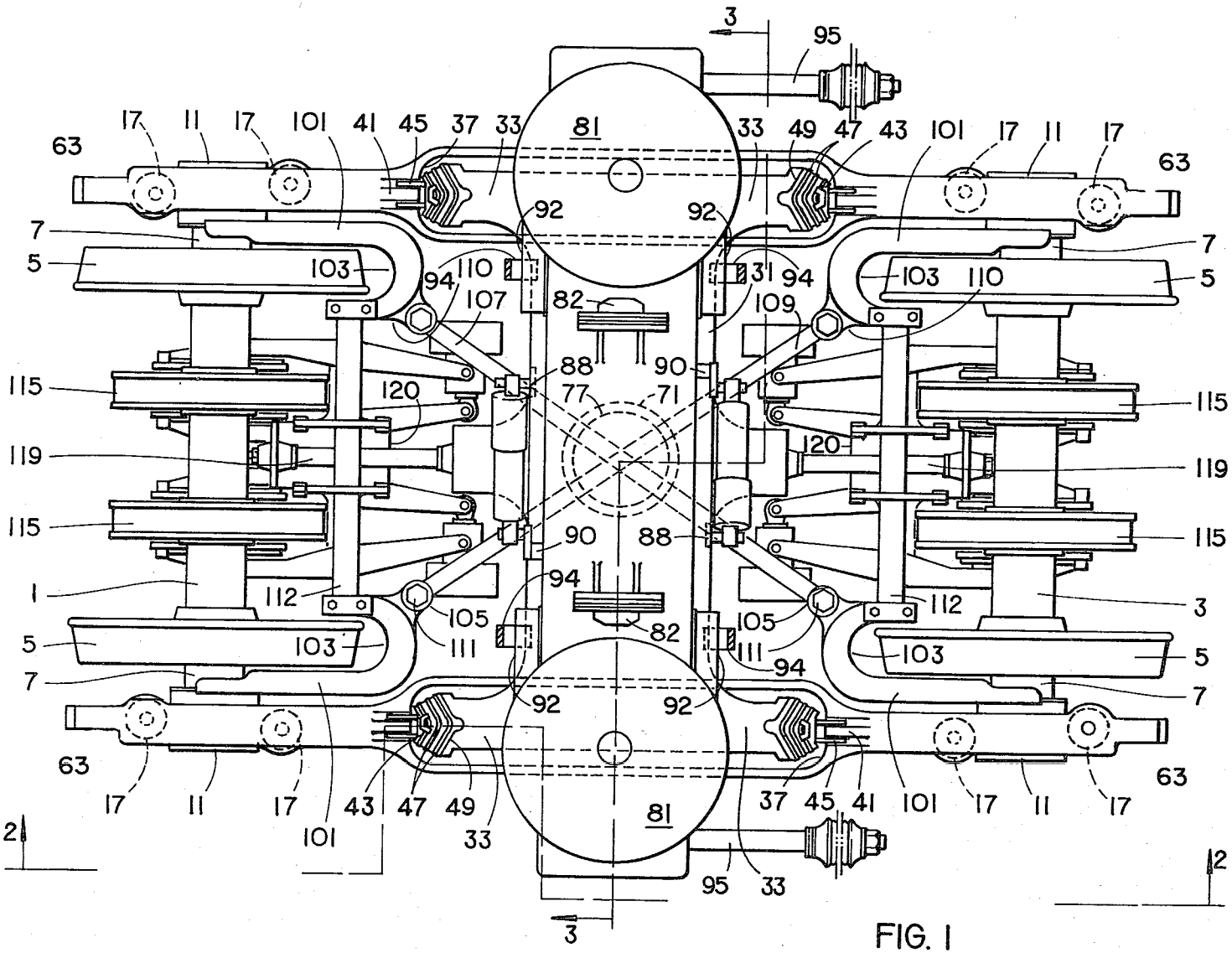
FIG. 1 is a plan view of a railway truck constructed in accordance with the invention.
Figure 4:
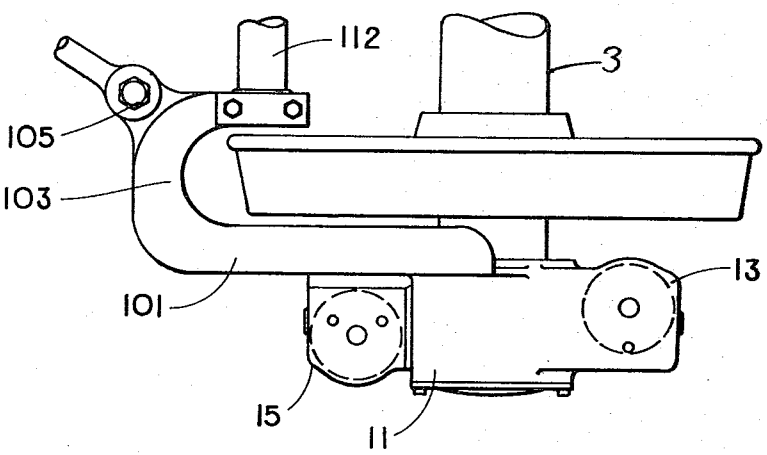
FIG. 4 is a plan view of the journal bearing assembly.
Figure 7:
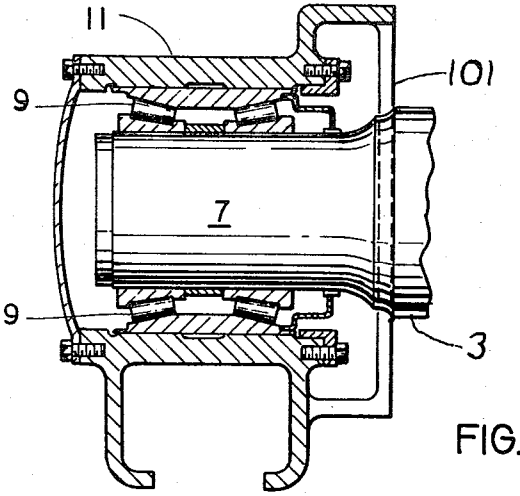
FIG. 7 is a transverse vertical sectional view taken along line 7—7 of FIG. 2.
Figure 2:
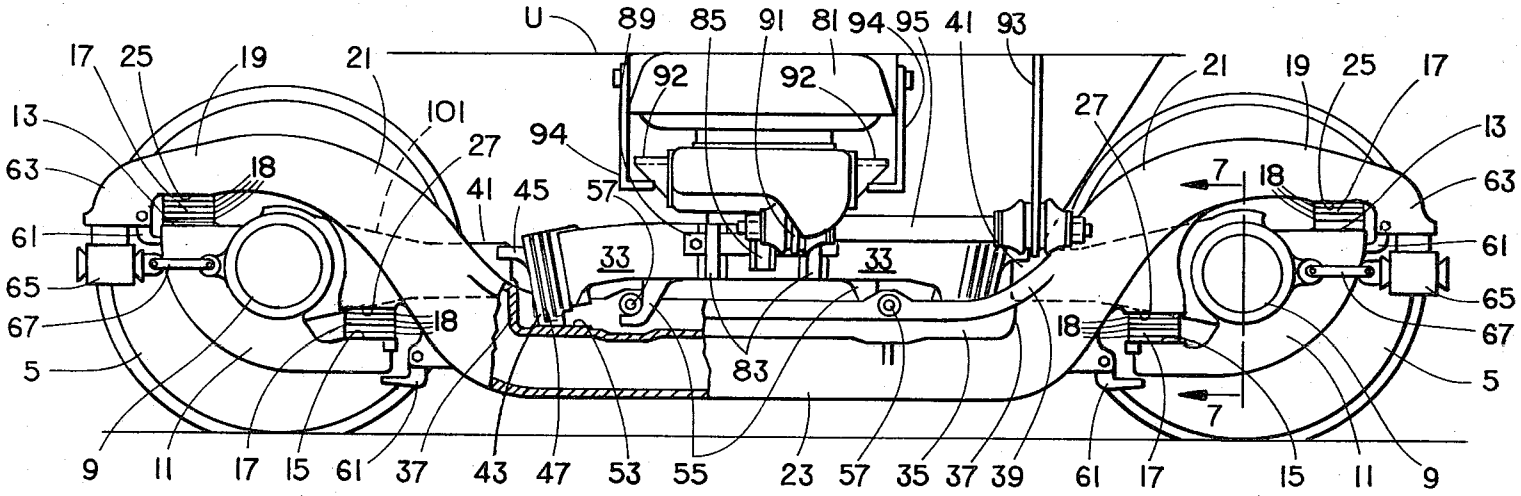
FIG. 2 is a side elevational view partially sectionalized through the side frame and the main frame along line 2—2 of FIG. 1.
Figure 3:
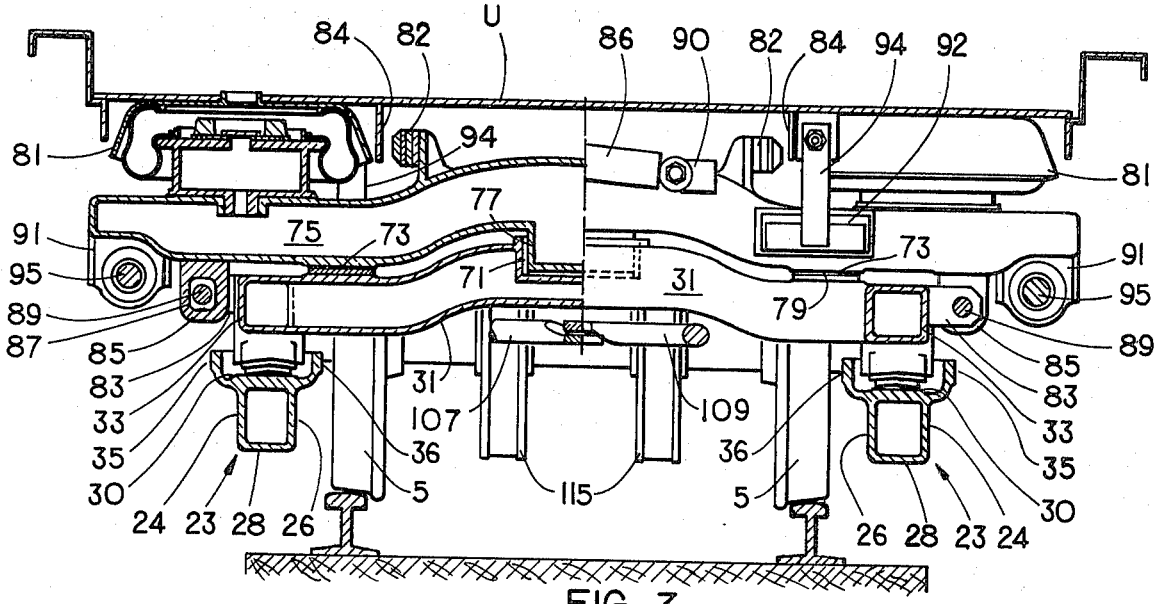
FIG. 3 is a transverse vertical sectional view taken along line 3—3 of FIG. 1.
Figure 5:
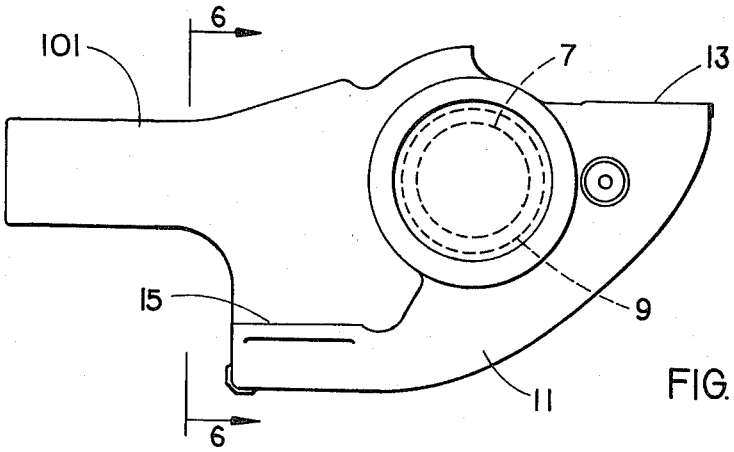
FIG. 5 is a side elevation of the journal bearing assembly.
Figure 6:
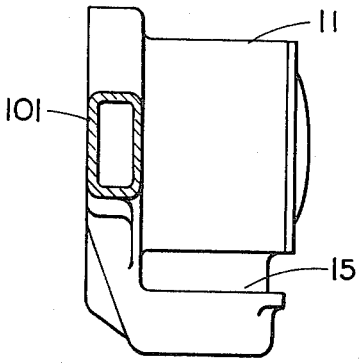
FIG. 6 is a transverse vertical sectional view along line 6—6 of FIG. 5 showing one side of the journal bearing assembly.

A railway vehicle truck has a pair of axles 1 and 3 parallel to each other and each mounting on its end portions a pair of railway flanged wheels 5, preferably having profiled treads of sufficient conicity to steer the axles into radial positions on track curves. The outwardly extending journal portions 7 of axles 1 and 3 are rotatably received in journal bearings 9 to which are secured adapters 11 having fore and aft upwardly facing surfaces 13 and 15 respectively, surfaces 13 being at a substantially higher level than the journal centers and surfaces 15 being at a substantially lower level than the journal centers, and substantially cylindrical upright elastomeric pad devices comprising a series of elastomeric discs 17 interleaved and bounded by metal plates 18 are seated respectively on bearing adapter surfaces 13 and 15, the pad devices 17, 18 seated on surfaces 15 being centered transversely outboard of the journal center and the pad devices 17 seated on surfaces 13 being positioned a similar distance inboard of the respective journal center for a purpose which will be described in greater detail herein below.

Longitudinally extending side frames having end portions 19 overlying the journal bearings, sloping intermediate portions 21 extending toward the center of the truck from end portions 19 and a depressed substantially horizontal center portion 23 are carried on elastomeric pad devices 17 by downwardly facing surfaces 25 and 27 on side frame end portions 19 and sloping portions 21 respectively. Pad devices 17, 18 are yieldable in shear horizontally to permit yawing movements of axles 3 and 5 with respect to side frames 19, 21, 23. Each side frame 19, 21, 23, by reason of the transverse spacing of the pad devices 17 on journal bearing adapter surfaces 13 and 15 is stably supported against tipping transversely of the truck. The side frames are generally of box section and are preferably of one piece cast steel construction. Side frames 19, 21, 23 are tied together by a main frame of I-shape in plan, comprising a single transverse transom 31 and longitudinally extending side members 33 resiliently supported at their ends on the depressed portions 23 of the respective side frames. To provide a desirably low location for main frame side members 33 with respect to the side frames, the depressed central portion 23 of each side frame has a box section lower portion with transversely spaced side walls 24 and 26, a horizontal bottom wall 28 and a top wall 30, and side walls 24 and 26 bowed outwardly and extended upwardly from the top wall as at 35 and 36 to form, with top wall 30, an upwardly open shallow channel, top wall 30 being bent upwardly adjacent the ends of the side frame depressed center portion to form a transverse web 37 defining, with top wall 30 and side wall extensions 35 and 36, an upwardly open shallow pocket. Additional strength is imparted to the side wall upward extensions 35 and 36 by flanges 39 extending along their upper margins. With this arrangement, the side members 33 of the main frame can be positioned at a desirably low level while keeping the side frame section of adequate strength. At each end of the recess defined by side walls 35 and 36 and end wall 37, an abutment 41 is formed on the sloping top surface of the intermediate sloping portions of the side frames and a V-shaped metal seat 43 having transversely spaced ears 45 is seated in the end portions of the side frame recesses, ears 45 embracing abutments 41 to hold the V-shaped member 43 against transverse movement with respect to the side frames. Ears 45 are welded to abutment 41 and the bottom of each seat 43 is welded to the bottom wall of the respective side frame recess such that each V-shaped seat 43 slopes toward the center of the truck longitudinally of the truck. Each seat 43 mounts an elastomeric chevron-shaped pad device 47 comprising a plurality of elastomeric pads interleaved and bounded by steel plates and the ends of the main frame side members 33 are formed with concave V-shaped surfaces 49 to engage the adjacent plate of the pad devices whereby the ends of each main frame side member 33 are resiliently supported on the chevron-shaped elastomeric pad devices 47, such that the side frames are capable of tipping about transverse axes with respect to the main frame and to each other while substantial longitudinal and transverse movements on the side frames with respect to the main frame are resisted by the compression resistance in the chevron pad devices 47.

The bottom wall of the recess is formed near its ends with upwardly facing machined pads 53 to permit the use of horizontal elastomeric pad devices (not shown) to support the main frame side members in lieu of the chevron pad devices 47. For maintaining the main frame against separation from the side frames, the bottom of the main frame side members are provided with depending J-shaped brackets 55, the lower ends of which underlie bolts 57 passing through recess side walls 35 and 36.

Similarly for preventing separation between the journal bearing adapters 11 and the side frames, small L-shaped plates 61 bolted to the bottom of side frame sloping portions 21 so as to underlie the inboard wings carrying bearing adapter surfaces 15 and similar plates 61 underlying bearing adapter surfaces 13 are bolted to side frame extensions 63 to the bottom of which are secured axle dampers 65 connected by suitable links 67 to the journal box adapters.

Bolster 75 extends well outboard of the frame side members and supports on its upper surface flexible wall pneumatic devices 81 on which vehicle underframe U is carried. For preventing separation of bolster 75 from main frame 31, 33, main frame side members 33 mount a pair of brackets 83 spaced longitudinally of the truck beneath the bolster and the bolster mounts a depending bracket 85 centrally apertured as at 87 to receive a longitudinally extending pin 89 mounted at its ends in frame brackets 83, aperture 87 being substantially larger than the diameter of pin 89 so as to freely accommodate necessary swivel movements of the truck main frame with respect to bolster 75.

For transmitting traction and braking forces between the underframe and the truck, the outer extremities of the bolster are formed with transverse plate-like brackets 91 and similar plate-like brackets 93 depend from the underframe U and a longitudinally extending anchor device 95, preferably constructed in accordance with J. C. Travilla U.S. Pat. No. 3,315,555, is connected at its respective ends to bolster bracket 91 and underframe bracket 93, anchor device 95 being capable of angular movement in all directions with respect to brackets 91 and 93 to accommodate lateral and vertical movements of the underframe U on the truck as are permitted by springs 81, but are substantially rigid longitudinally of the truck so as to prevent relative longitudinal movements of the bolster ends with respect to the underframe.

Lateral movements of underframe U with respect to the truck structure are limited by the engagement of elastomeric bumper devices 82 on bolster 75 and lateral stop brackets 84 depending from underframe U and lateral movements of the underframe respective to truck bolster 75 are dampened by transversely extending hydraulic snubbers 86, which are pivotally connected at one end to bracket 88 depending from the underframe and at the other end to bracket 90 on the bolster. For preventing separation of the underframe from the bolster, the bolster is provided with shelf-like brackets 92 projecting in both directions longitudinally of the truck and L-shaped plates 94 are secured to the underframe with its horizontal lower end underlying the respective bolster brackets 92.

Each of the journal bearing adapters 11 is formed with an arm 101 positioned inwardly of the respective side frame and outwardly of the adjacent wheel and spaced sufficiently laterally from the side frame to avoid contact therewith during yawing movements of the respective axle. Arms 101 extend longitudinally of the truck from the respective journal bearing adapters toward the main frame and a short distance longitudinally inwardly from the respective wheels are bent transversely inwardly as at 103 and are there formed with vertical axis clevises 105, and a pair of rods 107 and 109 are pinned respectively as at 111 to diagonally opposite clevises 105, such that the projections of rods 107 and 109 pass through the journal centers of the respective axles 1 and 3.

Clevises 105 and rods 107 and 109 are at the same level as the centers of the respective axles and the central arching of main frame transom 31 permits both of the rods to pass beneath it without interference, the rods being cylindrical except for their central portions which are flattened to permit one to pass over the other. It will be noted that the relatively outboard positions of the inner elastomeric pad devices 17 on each of the bearing adapters eliminates the possibility of interference with arms 101, 103 during yawing movements of the axle and that the laterally inboard location of the outer elastomeric pad devices 17, which is made possible by the absence of interfering structure on the journal bearing adapters, cooperate to opposite forces tending to tip the side frames transversely of the truck.

It will be evident that when operating on curved track, the diagonal rods 107 and 109 will permit the profiled high conicity wheel treads to steer the respective axles 1 and 3 into radial positions by accommodating movements of the axles equal in magnitude but opposite in sense and that at all times tendencies of the truck to hunt will be opposed by diagonal links 107 and 109 by causing any yawing movements of either axle to be transmitted to the other axle but in the opposite sense, thereby ensuring that oscillations of the wheel and axle assemblies are always out of phase with each other and with the other parts of the truck structure.

Additional damping of yawing movements of the respective axles is provided by the friction dampers 65, which are connected by links 67 to the respective journal bearing adapters.

The inner end of journal bearing arms 101 may be rebent toward axles 1 and 3 as at 110 to support a transverse bearing 112 for mounting disc brake mechanism, as disclosed in Keith L. Jackson application Ser. No. 289,471, filed Aug. 3, 1981, particularly FIGS. 6–9 thereof.

Each of the axles mounts a pair of cooperating brake discs 115 spaced apart transversely of the respective axle from each other and inwardly from the adjacent wheels 5. A longitudinally extending link 119 connecting each brake mechanism fulcrum plate 120 to the truck frame transom 31 takes braking torque reaction into the truck frame in a horizontal longitudinal direction opposite to the direction of movement of the truck along the track so as to oppose forward inertial movement of the truck frame relative to the axles during brake applications and thereby maintain the normal longitudinal relationship of the axles and the truck frame under braking conditions.

Operation of the truck is as follows: As a car equipped with trucks constructed in accordance with the invention moves along a track, while on tangent track the truck parts are in the same relative positions shown in FIG. 1, and as the car enters a curve, the profiled high conicity wheel treads cause the respective axles 1 and 3 to assume radial positions in which the journal bearing assemblies on the inside of the curve move principally longitudinally toward the center of the truck and those on the outside of the curve move principally longitudinally toward the adjacent ends of the truck, such longitudinal movement being accommodated by horizontal shear in elastomeric pad devices 17, 18. At the same time journal bearing adapter arms 101, being rigid with the journal bearing adapters, make corresponding movements, those adjacent the outside of the truck curve moving toward the adjacent side frame end portions 19, and due to the laterally outward positioning of the longitudinally inboard elastomeric pad devices 17, 18, the latter offer no interference with such movement of the journal bearing assembly arms. At the same time the lateral spacing of the inboard and outboard elastomeric pad devices 17, 18 stabilizes the respective side frames against tipping transversely of the truck.

As the respective wheel and axle assemblies assume radial positions while rounding curves, this movement of the wheel and axle assemblies is freely accommodated by the diagonal links 107 and 109. At all times, any yawing oscillations of either axle will be transmitted to the other axle but in the opposite sense by links 107 and 109, thus ensuring that oscillations of the respective wheel and axle assemblies are always out of phase with each other and with other parts of the truck structure, and thereby opposing tendencies of the truck to hunt. The low level support, via chevron devices 47 of the main frame side members 33 on the side frames accommodated by the recess or pocket formed in the side frame depressed center portions 23 also helps to stabilize the respective side frames against tipping transversely of the truck and the recesses or pockets in the respective side frames provide adequate clearance below the main frame side members 33 for some vertical movements of the main frame side members with respect to the side frames and permit relative tilting of the respective side frames about a transverse axis with respect to each other and to the main frame to accommodate to vertical irregularities in the respective track rails. The provision of a beam-type side frame, as distinguished from a truss-type side frame, accommodates the outboard extensions of the bolster 75 and the provision of the pockets in the top of the side frame depressed center portions 23 and the effective extension upwardly thereof of the side frame side walls 24 and 26 provide an adequate cross section for the side frames to support the required load without requiring upward extension of the side frame members as in conventional truss-shaped side frames.

The details of the truck structure disclosed herein may be varied substantially without departing from the spirit of the invention and the exclusive use of such modifications as come within the scope of the appended claims is contemplated.

We claim:

1. A radial axle railway vehicle truck comprising a pair of longitudinally spaced wheel and axle assemblies, each having an axle and a pair of railway flanged wheels fixedly mounted on its end portion, bearing assemblies each including a bearing rotatably receiving an end of each of said axles outboard of said wheels and having upwardly facing horizontal surfaces fore and aft of the respective bearings, the surfaces nearest the ends of the truck being at a higher level than the axle centers and the surfaces remote from the ends of the truck being at a level lower than the respective axle centers, said upper surfaces being positioned at least in part transversely inboard of the bearing center and the lower surfaces being positioned at least in part transversely outboard of the bearing center, elastomeric pad devices seated on said bearing assembly surfaces and being correspondingly positioned inboard and outboard respectively with respect to said bearing center, longitudinally extending side frames at the respective sides of said truck having downwardly facing horizontal surfaces vertically aligned with said bearing assembly surfaces and seated on said pad devices, said pad devices being yieldable in shear to accommodate yawing movements of the respective axles relative to said side frames, said side frames each having a depressed central portion, end portions overlying the respective bearing assemblies and intermediate sloping portions connecting said overlying end portions and said depressed central portion, and a main frame resiliently supported on both said side frames by vertically yieldable resilient means and held thereby against substantial longitudinal and lateral movements with respect to said side frames.

2. A radial axle railway vehicle truck according to claim 1, wherein said main frame has longitudinally extending side portions and said central portion of each side frame is a beam of box section having side walls and top and bottom walls, with its side walls extended upwardly from its top wall to provide an upwardly open shallow recess in its upper surface, said vertically resilient means being positioned in the end portions of said recess, each said recess accommodating necessary vertical movements of said main frame side portions relative to the respective side frames while permitting a desirably low height for said resilient members and maintaining a cross section of adequate strength for said side frame throughout its depressed central portion.

3. A radial axle railway vehicle truck according to claim 2, wherein said vertically resilient means includes an elastomeric pad of generally V-shape in plan with its apex pointing longitudinally of the truck toward the center of the respective side frame, surfaces of convex correspondingly V-shape on the side frames slightly inclined upwardly and outwardly longitudinally of the truck and directly supporting said pad devices, said main frame side portions being formed with similarly inclined concave V-shape surfaces seated on said elastomeric pad devices.

4. A radial axle railway vehicle truck according to claim 3, including seat members providing said V-shaped surfaces, said side frames having upstanding abutments on their sloping portions engaging vertical rear surface portions of said seat members, said seat members resting on the bottoms of the respective side frame recesses and being formed with lugs engageable with the sides of said abutments to hold said seat members against movement transversely of the respective side frames.

5. A radial axle railway vehicle truck according to claim 3, wherein said main frame side portions are formed with depending hook-like projections extending into the respective side frame recesses, there being transverse pin-like members extending between the side frame walls defining the respective side frame recesses and normally overlying the projecting end portions of said depending hook-like members to prevent vertical separation of said main frame from the respective side frames.

6. A radial axle railway vehicle truck according to claim 1, wherein the respective side frames extend longitudinally outwardly beyond the respective axle bearing assembly, longitudinally acting damping devices supported from said side frame extensions and longitudinally extending links connecting said damping devices and the respectively adjacent bearing assemblies.

7. A radial axle railway vehicle truck according to claim 6, wherein said side frame extensions mount removable elements underlying a portion of the adjacent journal bearing assembly and said side frame sloping portions mount removable elements underlying the opposite end of the adjacent bearing assemblies to prevent vertical separation of the respective side frames from the bearing assemblies while accommodating limited vertical movement of the respective side frames relative to the bearing assemblies and limited longitudinal movement of the respective bearing assemblies relative to the side frames.

8. A radial axle railway vehicle truck according to claim 1, wherein said side frames mount removable elements having horizontal portions underlying said journal bearing assembly horizontal surfaces to prevent vertical separation of the respective journal bearing assemblies from said side frames, said removable elements having vertical portions spaced longitudinally from said bearing assemblies a sufficient distance to permit limited yawing movement of the respective wheel and axle assemblies.

9. A radial axle railway vehicle truck according to claim 8, wherein one of said removable elements associated with each bearing assembly is mounted on the end portion of the respective side frame and said other removable element is mounted on the sloping intermediate portion of the respective side frame.

10. A radial axle railway vehicle truck according to claim 1, wherein said main frame is of I-shape in plan having side portions substantially the same length as the depressed center portions of the respective side frames and a central transverse transom connecting said side portions.

11. A radial axle railway vehicle truck according to claim 10, wherein each of said journal bearing assemblies has an arm at axle level extending generally parallel to the respective side frame and inboard thereof toward the center of the truck, there being a pair of diagonal rods pivotally connected on vertical axes to diagonally opposite arms.

12. A radial axle railway vehicle truck according to claim 11, wherein the central portion of said transom is upwardly arched to facilitate the passage thereunder of said rods.

13. A radial axle railway vehicle truck according to claim 12, including a transverse bolster supported on said main frame for swivel movement about the center of said transverse transom.

14. A radial axle railway vehicle truck according to claim 13, wherein said bolster is correspondingly upwardly arched to clear said transom.

15. A radial axle railway vehicle truck according to claim 11, wherein said elastomeric pad devices on the lower surfaces of said journal bearing assemblies are positioned sufficiently transversely outwardly to clear said arms during maximum yawing movements of the respective wheel and axle assemblies.

16. A radial axle railway vehicle truck according to claim 1, wherein said elastomeric pad devices on said bearing assembly surfaces have equal dimensions in plan transversely and longitudinally of the truck.

17. A radial axle railway vehicle truck according to claim 16, wherein said elastomeric pad devices are circular in plan.

* * * * *